US005824133A

United States Patent [19]

Tranquilla

[11] Patent Number: 5,824,133

[45] Date of Patent: Oct. 20, 1998

[54] MICROWAVE TREATMENT OF METAL BEARING ORES AND CONCENTRATES

[75] Inventor: James M. Tranquilla, Fredericton, Canada

[73] Assignee: EMR Microwave Technology Corporation, New Brunswick, Canada

[21] Appl. No.: 614,352

[22] Filed: Mar. 12, 1996

[51] Int. Cl.[6] ..... C22B 4/00

[52] U.S. Cl. ..... 75/10.13; 75/423; 219/693; 219/697

[58] Field of Search ..... 75/10.13, 423; 219/693, 696, 750

[56] References Cited

U.S. PATENT DOCUMENTS

| | | | |
|---|---|---|---|
| 3,261,959 | 7/1966 | Connell et al. | 75/10.13 |
| 4,311,520 | 1/1982 | Kruesi et al. | 75/80 |
| 4,321,089 | 3/1982 | Kruesi et al. | 75/84.5 |
| 4,324,582 | 4/1982 | Kruesi et al. | 75/1 |
| 4,714,812 | 12/1987 | Haagensen et al. | 219/750 |
| 5,074,909 | 12/1991 | Agar | 75/423 |

FOREIGN PATENT DOCUMENTS

| | | |
|---|---|---|
| 1092861 | 11/1967 | United Kingdom . |
| WO 92/18249 | 10/1992 | WIPO . |

OTHER PUBLICATIONS

D.H. Bradhurst, et al., "The Applications of Microwave Energy in Mineral Processing and Pyrometallurgy in Australia", SPRECHSAAL, vol. 123, No. 2, 1990, pp. 194–197. No Month.

*Primary Examiner*—Melvyn Andrews
*Attorney, Agent, or Firm*—Morgan, Lewis & Bockius LLP

[57] ABSTRACT

The present invention provides a new and useful method for bringing about a metallurgical effect in a metal-containing ore or concentrate comprising treating said ore in a resonant microwave cavity while maximizing electric field strength in the area of said ore in said cavity.

27 Claims, 1 Drawing Sheet

MICROWAVE TREATMENT OF METAL BEARING ORES AND CONCENTRATES

FIELD OF THE INVENTION

This application relates to methods for bringing about metallurgical effects by the application of microwave energy to metal bearing ores and concentrates.

BACKGROUND OF THE INVENTION

Mineral processing operations can consist of a number of unit operations including mining, comminution, concentration, roasting/smelting or leaching, separation and refining. Generally, post mining operations (ie. milling) involve most unit operations. As a result, process economics and environmental concerns are largely associated with milling operations.

Current technologies often have operational and environmental limitations. Electromagnetic energy, particularly at microwave frequencies, has considerable potential to address many of these limitations. It has been known for some time that certain metallurgical effects can be brought about in metal bearing ores and mineral concentrates by treatment with microwaves such that the ore or concentrate becomes more amenable to conventional leaching techniques. For example, it is known that refractory gold concentrates can be treated with microwaves to, for example, transform pyrites into pyrrhotite and hematite, the latter being more reactive than the former and thus more readily processed by conventional techniques.

Similarly such processes have been carried out at bench scale for the recovery of molybdenum and rhenium from their sulphide ores; recovery of nickel, cobalt and manganese from their oxides and silicates; and recovery of copper from its ores.

To date none of these lab-scale processes have been scaled up to pilot or commercial operations.

Against this background, the present invention provides an improved means of processing metal bearing refractory ores or concentrates with the object of recovering, or rendering recoverable, precious metals, PGM, base metals, and radioactive metals present in the ore. These ores or concentrates are treated with microwaves to bring about a variety of chemical and mineralogical changes; for example, oxidation, reduction, vaporization or hydration, which result in refractory ores or concentrates becoming more amenable to conventional recovery processes.

PRIOR ART

Prior patents of interest comprise Kruesi U.S. Pat. No. 4,321,089, issued Mar. 23, 1982; Kruesi U.S. Pat. No. 4,311,520, issued Jan. 19, 1982; Kruesi U.S. Pat. No. 4,324,582, issued Apr. 13, 1982; Connell U.S. Pat. No. 3,261,959, issued Jul. 19, 1966; Beeby WO 92/18249 (PCT/AV92/00162), Oct. 29, 1992; Crawford U.K.P. 1,092,861, Nov. 29, 1967; Haque, Microwave Irradiation Pretreatment of a Refractory Gold Concentrate; CANMET, Ottawa, Canada; Bradhurst, et al., The applications of Microwave Energy in Mineral Processing and Pyrometallurgy in Australia, SPRECHSAAL, v. 123, No. 2, 1990.

SUMMARY OF THE INVENTION

It has now been discovered that very rapid and beneficial metallurgical effects can be achieved in metal containing ores by treating the ores or concentrates with microwave energy while maximizing the field strength of microwaves applied to the ores.

Thus, the invention provides a method for bringing about metallurgical effects in a metal-containing ore or concentrate comprising treating said ore or concentrate in a resonant microwave cavity while maximizing electric field strength in the area of said ore or concentrate in said cavity.

There is further provided a method for bringing about a metallurgical effect in metal containing ore or concentrate, said method comprising feeding a thin stream of said ore or concentrate rapidly through a resonant microwave cavity, generating microwave energy by means of a Microwave generating device, and applying said microwave energy through a waveguide to said cavity, coupling and tuning said cavity to said magnetron to maximize electric field strength in the area of said ore or concentrate in said cavity.

BRIEF DESCRIPTION OF THE DRAWINGS

These and other advantages of the invention will become apparent upon reading the following detailed description and upon referring to the drawings in which:FIG.

Figure 1:
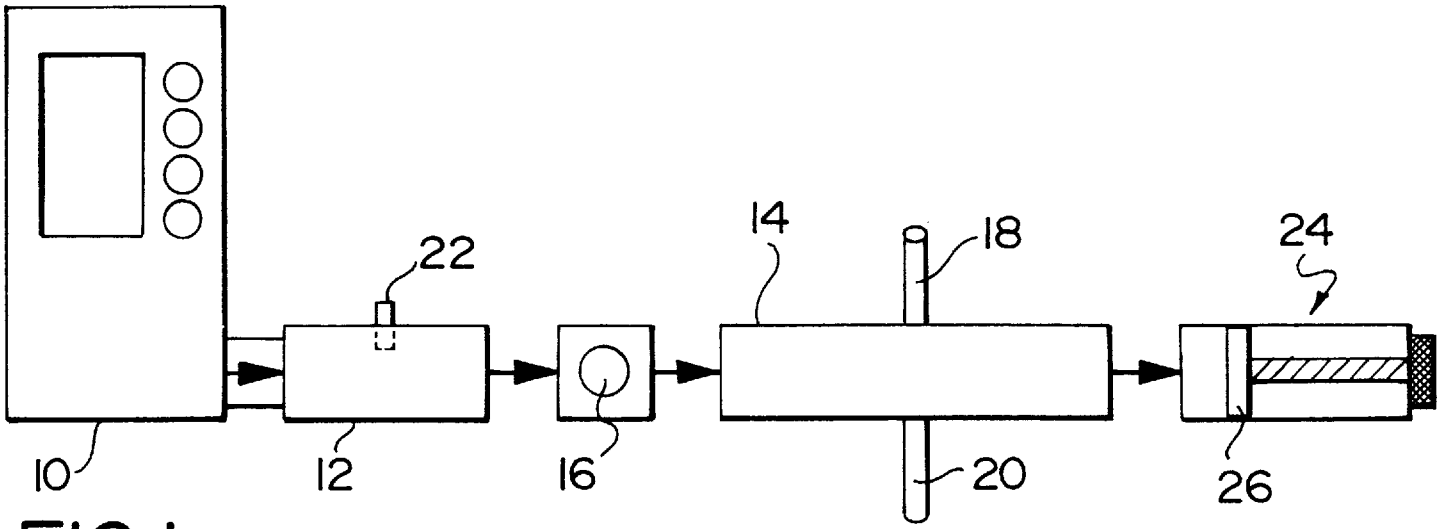
FIG. 1 is a schematic view of an apparatus for use with the invention.

While the invention will be described in conjunction with the illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

Throughout this document, the expression "ore" is intended to mean ore and/or concentrate.

In the following description, similar features in the drawings have been given similar reference numerals.

Two of the operational objectives frequently expressed in microwave applications generally, and in earlier lab-scale work directed at the use of microwaves to achieve metallurgical effects, have been either the uniform application of waves throughout a cavity (oven) or the maximization of energy transfer to the mass of material being treated. This may take place over a significant period of time. For example, Kruesi et al in the patents noted above are roasting for typical time periods of 10 to 15 minutes. The processes were assumed to be simply energy or heat driven.

Thus, heat being product of power and time, for given microwave power output the necessary energy requirement was met by using elongated dwell times.

A similar objective is clearly expressed in the utilization of the apparatus described in U.K. patent 1,092,861 wherein the main energy requirement is stated to be the heat required to raise the temperature of the mass of material being treated.

In contrast, the present case proposes that the processes with which it is concerned are power rather than energy related. Accordingly, if it is not necessary to convert power to heat, the field strength can be amplified many times without using energy. In combination with cavity geometry, dwell time can be reduced to lower energy dissipation.

The process will thus operate at extremely high quality factors (Q), since Q is obtained by dividing energy stored by energy dissipated.

In short, in contrast to previous such processes, the present invention seeks to minimize energy dissipation in the process and to maximize field strength in the microwave cavity.

The main elements of the maximization of field strength in the cavity comprise the optimization of coupling between the magnetron or other microwave generating device and the cavity, and of the resonant tuning of the cavity.

The coupling or matching of the cavity to the magnetron refers to the efficiency with which energy is delivered to the cavity. A practical measure of the efficiency is in the measure of energy reflected back from the cavity to the wave guide. Coupling is optimized as reflected energy is minimized.

Within the cavity a tuner is provided to enable the resonant frequency of the cavity to adjust to the frequency of the magnetron. This may also be based on monitoring of reflected power.

Figure 2:
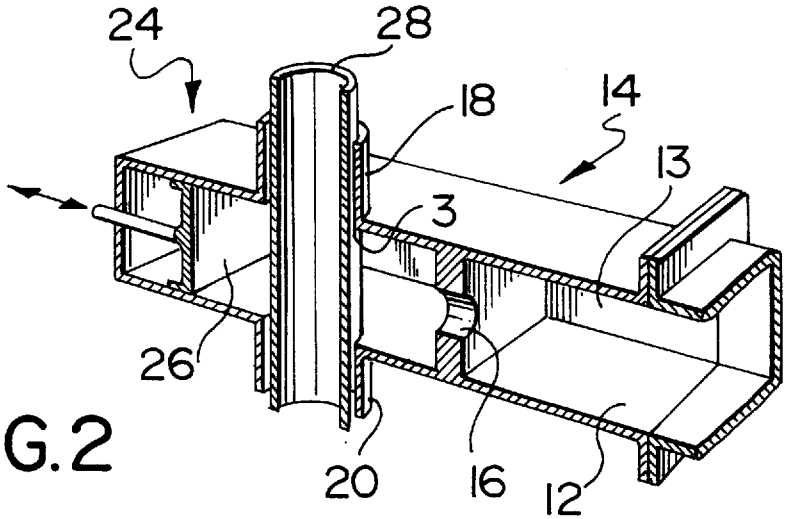
FIGS. 2 is a perspective view of an apparatus for use with the invention.

A preferred apparatus for carrying out the method is similar to that illustrated in FIG. 2 of U.K. patent 1,092,861.

With reference to FIGS. 1 and 2, the preferred apparatus comprises a high power microwave generator 10 delivering microwave energy through wave guide 12 to the applicator or cavity 14. Wave guide 12 is coupled to cavity 14 through iris 16.

The cavity 14 is provided with choke tubes 18 and 20. A coupling tuner 22 is located within wave guide 12 upstream of iris 16.

A resonance tuner 24 is located within cavity 14 and comprises a variable short circuit in the form of plunger 26.

A feed tube 28 extends through choke tubes 18 and 20 and cavity 14.

In addition to a measurement of power reflected back through the iris into the wave guide, other criteria to be measured and transmitted to a control computer comprise the position of plunger 26, the position of coupling tuner 22, temperatures at selected points within the cavity, the existence of arcing within the cavity (optical sensor), gas chromatographic measurements on the exit gas stream and material flow speed.

As indicated above, the coupling and resonance tuners are adjusted responsive to reflected power. Typically the coupling tuner is adjusted first followed by the resonance tuner. The tuning is preferably computer controlled on a continuous basis.

Responsive to temperature and arc detection, various adjustments may be made in the system such as reduction of applied power or shut-down. Similar adjustments may be made responsive to exit gas composition.

As well, the flow of material through the cavity may be adjusted responsive to temperature.

Preferably, the microwave generator will generate power levels in the range of 1 kw to 100 kw. A preferred power level is about 10 to about 50 kw. The specific energy delivered to ore or concentrate in the microwave cavity is in the range 250 to 300,000 Joules/gm. Dwell time of material passing through the chamber is less than 6 sec. and preferably in the area of 0.25 sec. The unloaded Q factor in the cavity is preferably in the range 1,000 to 25,000, but most preferably not less than 20,000.

The frequency of the microwave generator is in the range 300 MHz to 10 GHz. Preferred frequencies are 915 MHz and 2,450 MHz.

In one preferred embodiment the process can operate successfully with feed material comprising refractory gold or concentrate of less than about 6 mm and preferably less than about 200 mesh at a material flow rate of 40 kg./min., with power input of 10 kw and a device Q factor in the range of 25,000. Bulk temperature rise under these conditions from ambient will only be a few ° C. depending on the composition of the material.

After treatment in this matter, the concentrate is found to be much more amenable to conventional recovery processes.

Thus, it is apparent that there has been provided in accordance with the invention a MICROWAVE TREATMENT OF METAL BEARING ORES AND CONCENTRATES that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

The embodiments of the invention in which an exclusive property or privilege is claimed are defined as follows:

1. A method for bringing about metallurgical effect in a metal-containing ore or concentrate comprising the steps of generating microwave energy, delivering said energy to a resonant microwave cavity containing said ore or concentrate while maximizing electric field strength of said energy to said ore or concentrate in said cavity.

2. A method for bringing about metallurgical effect in a metal-containing are or concentrate comprising the steps of generating microwave energy, delivering said energy to a resonant microwave cavity containing said ore or concentrate for a short time in a thin stream while maximizing electric field strength of said energy to said thin stream of ore or concentrate in said cavity.

3. A method of bringing about metallurgical effect in a metal-containing a or concentrate, said method comprising:

feeding a thin stream of said ore rapidly through a resonant microwave cavity;

generating microwave energy by means of a microwave generating device and applying said microwave energy through a wave guide to said cavity;

coupling and tuning said cavity to said microwave generating device to maximize electric field strength of said energy to said ore or concentrate in said cavity.

4. The method of claim 3 wherein said ore is a concentrate.

5. The method of claim 3 wherein said ore or concentrate has a particle size of less than about 6 mm.

6. The method of claim 4 wherein said ore or concentrate has a particle size of less than about 200 mesh.

7. The method of claim 3 wherein said microwave generating device generates a power level in the range of 1 kw to 100 kw.

8. The method of claim 7 wherein said power level is about 50 kw.

9. The method of claim 8 wherein the microwave energy delivered to said ore or concentrate in said cavity is in the range of 250 to 300,000 joules/gm.

10. The method of claim 9 wherein said ore or concentrate has a dwell time in said cavity of not more than 6 sec.

11. The method of claim 3 wherein said cavity has an unloaded Q factor in the range of 1,000 to 25,000.

12. The method of claim 11 wherein said Q factor is not less than 20,000.

13. The method of claim 3 wherein said coupling and tuning steps are controlled by a computer process to achieve optimal transfer of energy from the microwave energy generating device to said cavity.

14. The method of claim 13 wherein said computer control process comprises controlling said coupling by adjustment of a coupling tuner in said waveguide and subsequent adjustment of a resonance tuner in said cavity.

15. The method of claim 14 wherein said control process is carried out continuously.

16. The method of claim 14 wherein controlling said coupling comprises measuring power that is reflected from said cavity by adjusting said coupling tuner to reduce the power that is reflected.

17. The method of claim 14 wherein said adjustment of a resonance tuner comprises measuring power that is reflected from said cavity and adjusting said resonance tuner to minimize said reflected power.

18. The method of claim 3 comprising the step of measuring temperature in said ore or concentrate in said cavity and controlling microwave power input responsive to said temperature.

19. The method of claim 3 wherein said microwave generating device operates at a frequency of between 300 MHz and 10 GHz.

20. The method of claim 19 wherein said microwave generating device operates at a frequency of 915 MHz.

21. The method of claim 19 wherein said microwave generating device operates at a frequency of 2,450 MHz.

22. The method of claim 3 wherein said ore or concentrate is refractory sulphide gold ore concentrate.

23. The method of claim 22 wherein the energy generated by said microwave generating device and applied to said cavity is in the range of 1 kw to 100 kw.

24. The method of claim 23 wherein the specific energy delivered to said ore in said cavity is less than 20,000 Joules per gram.

25. The method of claim 24 wherein the unloaded Q factor in said cavity is at least 20,000.

26. The method of claim 3 comprising a preliminary step of admixing with said ore or concentrate a reactant substance for enhancing said metallurgical effect.

27. The method of claim 26 wherein said ore or concentrate is refractory sulphide gold ore concentrate and said reactant substance is lime.

* * * * *